US009399995B2

(12) United States Patent
Park et al.

(10) Patent No.: US 9,399,995 B2
(45) Date of Patent: Jul. 26, 2016

(54) COMPRESSOR SYSTEM AND METHOD OF CONTROLLING THE SAME

(71) Applicant: HANWHA TECHWIN CO.,LTD., Changwon-Si (KR)

(72) Inventors: Geun-Yun Park, Changwon (KR); Do-Hyeong Kim, Changwon (KR)

(73) Assignee: Hanwha Techwin Co., Ltd., Changwon-si (KR)

( * ) Notice: Subject to any disclaimer, the term of this patent is extended or adjusted under 35 U.S.C. 154(b) by 433 days.

(21) Appl. No.: 13/962,047

(22) Filed: Aug. 8, 2013

(65) Prior Publication Data

US 2014/0314543 A1 Oct. 23, 2014

(30) Foreign Application Priority Data

Apr. 19, 2013 (KR) ..... 10-2013-0043816

(51) Int. Cl.
*F04D 15/00* (2006.01)
*F04D 27/00* (2006.01)
*F04D 27/02* (2006.01)

(52) U.S. Cl.
CPC ..... *F04D 15/0005* (2013.01); *F04D 27/0215* (2013.01); *F04D 27/0223* (2013.01); *F04D 27/0253* (2013.01)

(58) Field of Classification Search
CPC ..... F04D 15/0005; F04D 27/0215; F04D 27/0223; F04D 27/0253
USPC ..... 415/1, 13, 17, 20, 27, 29, 30, 36, 146
See application file for complete search history.

(56) References Cited

U.S. PATENT DOCUMENTS 4,646,530 A * 3/1987 Huenniger ..... F04D 27/0253 62/175
4,944,652 A * 7/1990 Blotenberg ..... F04D 27/0207 415/1
5,355,691 A * 10/1994 Sullivan ..... F04D 27/0261 415/17
5,508,943 A 4/1996 Batson et al.
9,200,572 B2 * 12/2015 Hoang ..... F04D 27/001
2005/0154479 A1 * 7/2005 Narayanan ..... F04D 27/0284 700/75
2013/0309060 A1 * 11/2013 Johnsen ..... F04D 17/10 415/1

FOREIGN PATENT DOCUMENTS

JP 2005-146927 A 6/2005
JP 2005-226561 A 8/2005
JP 2007-212040 A 8/2007
JP 4634727 B2 11/2010

* cited by examiner

*Primary Examiner* — Hoang Nguyen
(74) *Attorney, Agent, or Firm* — Sughrue Mion, PLLC

(57) ABSTRACT

Provided is a compressor system including: a guide vane; a compressor compressing a fluid flowing from the guide vane; a drive unit connected to the compressor and driving the compressor; a guide flow path connecting the compressor and an external device; a branch flow path branching off from the guide flow path; a flow control valve opening and closing the branch flow path; a sensor unit measuring a current of the drive unit and a pressure of the guide flow path; and a control unit controlling at least one of the guide vane, the drive unit, and the flow control valve, calculating an operation point of the compressor, comparing the operation point of the compressor with a greater one of a first anti-surge control line and a second anti-surge control line and controlling the flow control valve according to the comparison.

19 Claims, 2 Drawing Sheets

COMPRESSOR SYSTEM AND METHOD OF CONTROLLING THE SAME

CROSS-REFERENCE TO RELATED PATENT APPLICATION

This application claims priority from Korean Patent Application No. 10-2013-0043816 filed on Apr. 19, 2013, in the Korean Intellectual Property Office, the disclosure of which is incorporated herein by reference in its entirety.

BACKGROUND

1. Field

Apparatuses and methods consistent with exemplary embodiments relate to a compressor system and a method of controlling the same.

2. Description of the Related Art

In turbo compressors, when the compressors do not produce greater pressure than the pressure resistance of systems, periodic fluid backflows occur inside compressors, which are designated as surges. When the surges occur, fluids regularly flow back in such a way that minute changes in pressure and flow cause mechanical vibrations that may damage bearings and impellers. The surges as described above deteriorate the performance of compressors and reduce the lifespan thereof. Therefore, surge prevention is a significant aspect of controlling the turbo compressors.

In compressor systems of the related art, to prevent such surges, surge control lines are set up in function charts of compressors, and the compressor systems are controlled through the surge control lines. Japanese Patent Laid-open Publication No. 2007-212040, titled Turbo refrigerator and its control method, filed by MITSUBISHI HEAVY IND LTD, discloses a method of controlling a compressor system in which control is performed by setting a surge control line having a margin of about 10% from a surge line, which corresponds to a condition where a surge of a compressor occurs, set in the function chart to prevent the surge and by using an opening rate of an inlet vane and a hot gas bypass.

Also, Japanese Patent Laid-open Publication No. 2005-226561, titled Low duty compressor control method in LNG ship, filed by KAWASAKI SHIPBUILDING CORP, discloses a method of preventing a surge by setting a surge control zone, in addition to a surge control line, not to allow an operation point to be in the surge control zone.

SUMMARY

One or more exemplary embodiments provide a compressor system and a method of controlling the same, capable of performing active anti-surge.

According to an aspect of an exemplary embodiment, there is provided a compressor system including a guide vane; a compressor configured to compress a fluid flowing from the guide vane; a drive unit connected to the compressor and configured to drive the compressor; a guide flow path connecting the compressor and an external device; a branch flow path branching off from the guide flow path; a flow control valve configured to open and close the branch flow path; a sensor unit configured to measure a current of the drive unit and a pressure of the guide flow path; and a control unit configured to control at least one of the guide vane, the drive unit, and the flow control valve, configured to calculate an operation point of the compressor based on the current of the drive unit and the pressure of the guide flow path, configured to compare the operation point of the compressor with a greater one of a first anti-surge control line determined to be offset from the operation point by a first surge margin and a second anti-surge control line determined to be offset from a surge occurrence line by a second surge margin and configured to control the flow control valve according to the comparison.

The control unit may be configured to predetermine at least one of the first surge margin and the second surge margin.

The first anti-surge control line may vary in response to variation of the operation point.

The first anti-surge control line may vary in response to variation of a predetermined rate limit.

The control unit may control the flow control valve to allow the operation point to be over a first control point on the first anti-surge control line in response to the operation point being placed between the first anti-surge control line and the second anti-surge control line.

The first control point may include an intersection point between a pressure line of the guide flow path and the first anti-surge control line.

The control unit may control the flow control valve to allow the operation point to be over a second control point on the second anti-surge control line in response to the operation point being less than the second anti-surge control line.

The second control point may include an intersection point between a pressure line of the guide flow path and the second anti-surge control line.

The sensor unit may include a first sensor unit configured to measure the current of the drive unit and a second sensor unit configured to measure the pressure of the guide flow path.

The control unit may be configured to control the flow control valve to allow the operation point to move along a pressure line of the guide flow path.

According to an aspect of another exemplary embodiment, there is provided a method of controlling a compressor system including determining a first anti-surge control line offset from an operation point of a compressor by a first surge margin and a second anti-surge control line offset from a surge occurrence line by a second surge margin; determining a greater one of the first anti-surge control line and the second anti-surge control line; comparing the operation point of the compressor with the greater one of the first anti-surge control line and the second anti-surge control line; and controlling at least one of a guide vane and a flow control valve to allow the operation point of the compressor to be greater than the greater one of the first anti-surge control line and the second anti-surge control line.

The method may further include predetermining at least one of the first surge margin and the second surge margin.

The first anti-surge control line may vary in response to variation of the operation point.

The first anti-surge control line may vary in response to variation of a predetermined rate limit determined by the control unit.

The controlling includes controlling the flow control valve to allow the operation point to be over a first control point on the first anti-surge control line in response to the operation point being placed between the first anti-surge control line and the second anti-surge control line.

The first control point may be an intersection point between a pressure line of the guide flow path and the first anti-surge control line.

The controlling may include controlling the flow control valve to allow the operation point to be over a second control point on the second anti-surge control line in response to the operation point being less than the second anti-surge control line.

The controlling may include controlling the flow control valve to allow the operation point to move along a pressure line of the guide flow path.

BRIEF DESCRIPTION OF THE DRAWINGS

The above and/or other features and advantages of the disclosure will become more apparent by describing in detail exemplary embodiments thereof with reference to the attached drawings in which.

DETAILED DESCRIPTION

The present inventive concepts will be clearly understood with reference to exemplary embodiments thereof, which will be described in detail, together with the attached drawings. However, the present inventive concepts will not be limited to the exemplary embodiments described below and may be embodied in various different forms. Merely, the exemplary embodiments are provided to perfectly disclose the present inventive concepts and to allow one of ordinary skill in the art to fully understand the inventive concepts.

Terms are used in the specification to describe the exemplary embodiments but not to limit the scope of the present inventive concepts. In the specification, a singular form includes a plural form if there is no particular mention. "Comprises" and/or "comprising" used in the specification do or does not exclude the existence or addition of one or more other elements, steps, operations, and/or devices in addition to an element, a step, an operation, and/or a device, which are mentioned. Terms such as "first" and "second" may be used to describe various elements, but the elements will not be limited to the terms. The terms are used merely to distinguish one element from another element.

Figure 1:
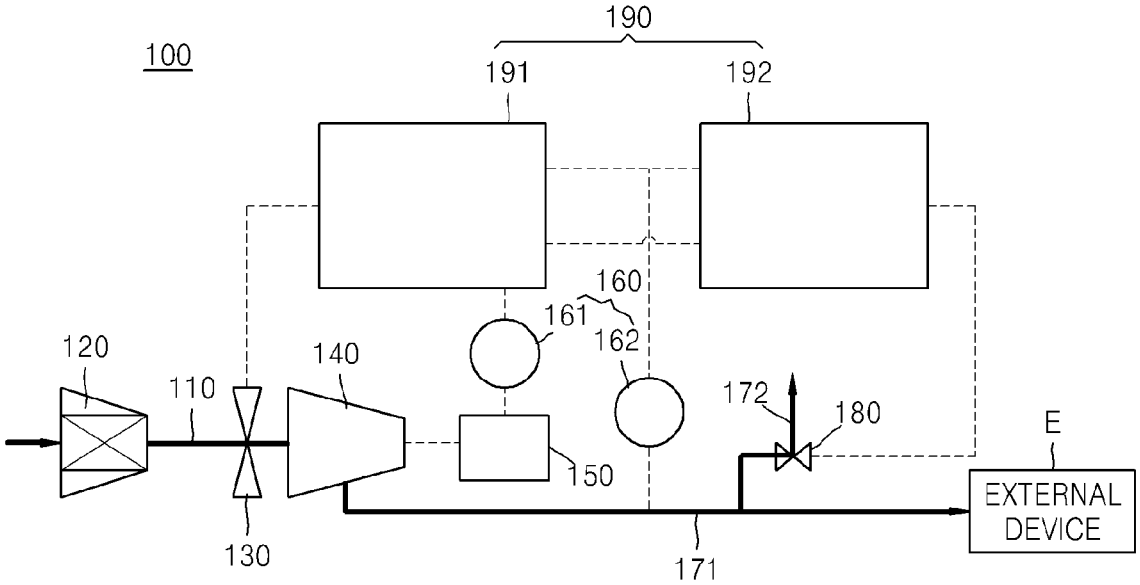
FIG. 1 is a concept view illustrating a flow of controlling a compressor system according to an exemplary embodiment.
Figure 2:
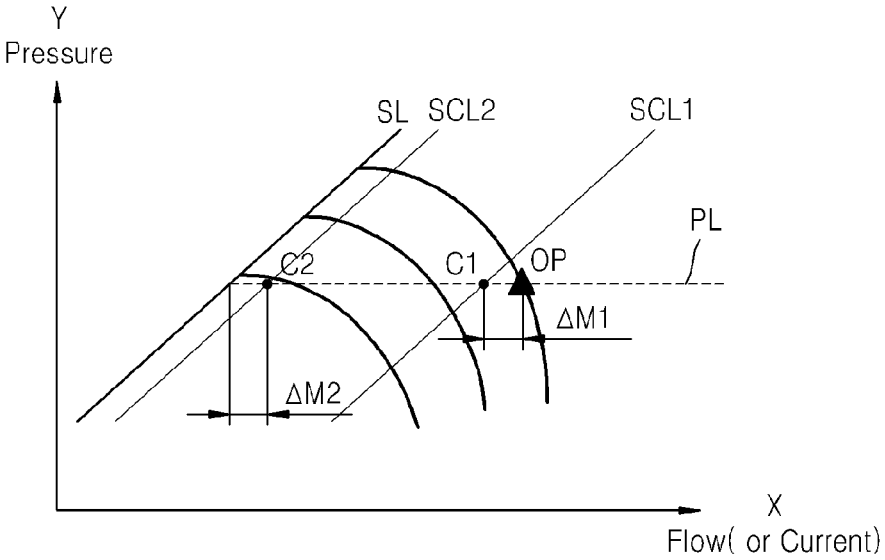
FIG. 2 is a graph illustrating a first operation state of the compressor system of FIG. 1 according to an exemplary embodiment.
Figure 3:
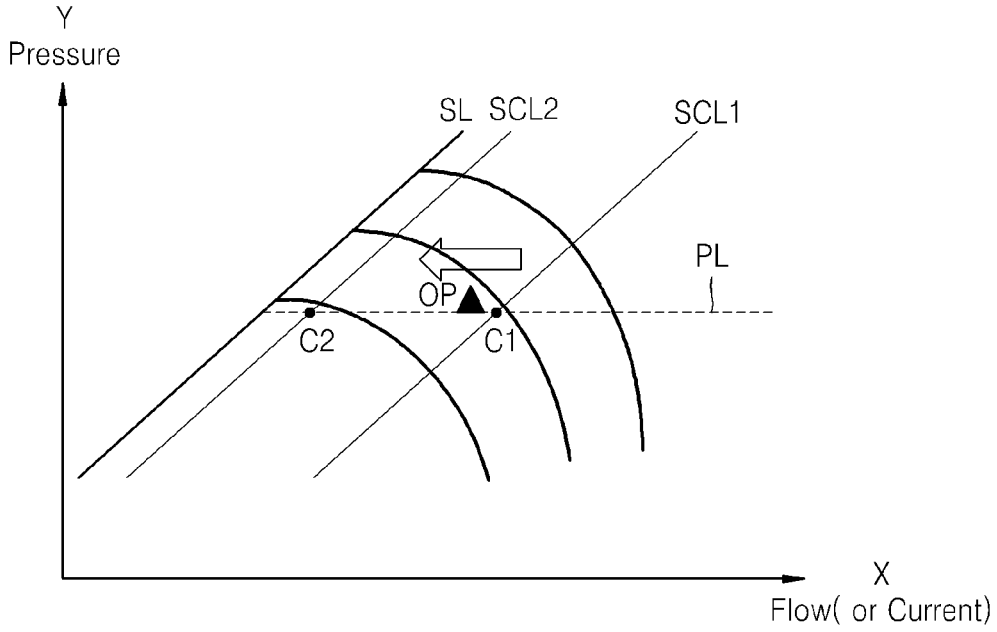
FIG. 3 is a graph illustrating a second operation state of the compressor system of FIG. 1 according to an exemplary embodiment.
Figure 4:
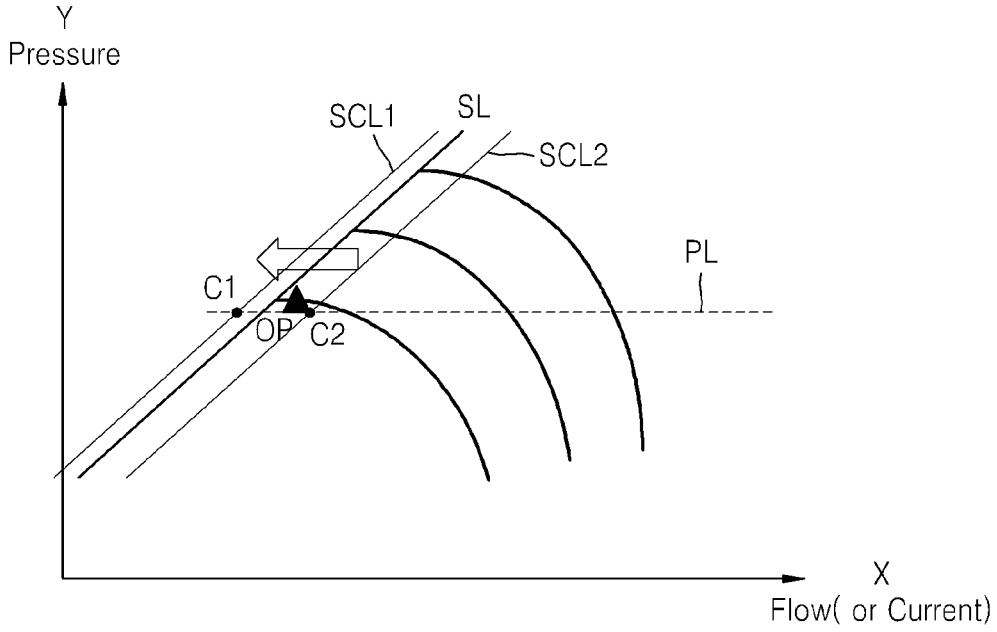
FIG. 4 is a graph illustrating a third operation state of the compressor system of FIG. 1 according to an exemplary embodiment.

FIG. 1 is a concept view illustrating a flow of controlling a compressor system 100 according to an exemplary embodiment. FIG. 2 is a graph illustrating a first operation state of the compressor system 100 according to an exemplary embodiment. FIG. 3 is a graph illustrating a second operation state of the compressor system 100 according to an exemplary embodiment. FIG. 4 is a graph illustrating a third operation state of the compressor system 100 according to an exemplary embodiment.

Referring to FIGS. 1 to 4, the compressor system 100 may include a supply flow path 110 guiding a fluid flowing from the outside. Also, the compressor system 100 may include an inlet filter 120 installed on the supply flow path 110 to remove foreign substances of the fluid.

The compressor system 100 may include a guide vane 130 installed on the supply flow path 110 to control an amount of the fluid discharged from the inlet filter 120 and flowing through the supply flow path 110. An inner area of the guide vane 130 is changed, thereby controlling the amount of fluid flowing through the supply flow path 110. Particularly, since the guide vane 130 is similar to guide vanes of the related art, a detailed description thereof is omitted.

The compressor system 100 may include a compressor 140 connected to the supply flow path 110 and compressing the fluid flowing through the guide vane 130. Also, the compressor system 100 may include a drive unit 150 connected to the compressor 140 and driving the compressor 140. In the exemplary embodiment, the drive unit 150 may include a motor.

The compressor system 100 may include a guide flow path 171 connected to the compressor 140 and guiding the compressed fluid to an external device (E). In the exemplary embodiment, the external device (E) may correspond to various devices. For example, the external device (E) may include a combustor. Also, the external device (E) may include a condenser. Hereinafter, for the convenience of description, an example in which the external device (E) is a combustor will be described in detail.

The compressor system 100 may include a branch flow path 172 branching off from the guide flow path 171 and connected outwardly. Also, the compressor system 100 may include a flow control valve 180 installed on the branch flow path 172 and opening and closing the branch flow path 172.

Also, the compressor system 100 may include a sensor unit 160 for measuring a current of the drive unit 150 and a pressure of the guide flow path 171. In the exemplary embodiment, the sensor unit 160 may be provided in plural. For example, the plurality of sensor units 160 may include a first sensor unit 161 measuring the current of the drive unit 150 and a second sensor unit 162 measuring the pressure of the guide flow path 171.

The compressor system 100 may include a control unit 190 controlling at least one of the guide vane 130, the drive unit 150, and the flow control valve 180. The control unit 190 may perform various functions. For example, the control unit 190 may calculate an operation point OP of the compressor 140 based on the current of the drive unit 150 and the pressure of the guide flow path 171 that are measured by the sensor unit 160. Also, the control unit 190 may determine a first anti-surge control line SCL1 offset from the operation point OP by a first surge margin ΔM1. Additionally, the control unit 190 may determine a second anti-surge control line SCL2 offset from a surge occurrence line SL by a second surge margin ΔM2. Also, the control unit 190 may compare the first anti-surge control line SCL1 and the second anti-surge control line SCL2 with each other to select one thereof, which has a greater value, and may compare the selected value with the operation point OP to control at least one of the guide vane 130 and the flow control valve 180.

The control unit 190 as described above may include a first controller 191 generating a first control value to allow the pressure of the guide flow path 171 to be the same as a predetermined pressure. In the exemplary embodiment, the first controller 191 may also generate a second control value to prevent an overcurrent flowing through the drive unit 150. Additionally, the first controller 191 may control the guide vane 130 by selecting a smaller one of the first control value and the second control value. The first control value and the second control value may be values for controlling a level of opening the guide vane 130 (e.g., an opening rate or opening area).

The control unit 190 may include a second controller 192 generating a third control value applied to the flow control valve 180 not to allow a surge to occur at the compressor 140. In the exemplary embodiment, the second controller 192 may also generate a fourth control value, different from the third control value, applied to the flow control valve 180 not to allow a surge to occur, may compare the third control value with the fourth control value, and may select a smaller one of the third control value and the fourth control value, thereby controlling the flow control valve 180.

The control unit 190 is not limited to the one described above but may be variously designed. For example, the control unit 190 may be a single unit or may be designed in plural as described above. However, hereinafter, for convenience of description, a case in which the control unit 190 includes the first controller 191 and the second controller 192 will be described in detail.

Considering a method of operating the compressor system 100, an external fluid may flow through the supply flow path 110 to the compressor 140 according to the operation of the compressor system 100. In the exemplary embodiment, the inlet filter 120 may remove foreign substances of the fluid, and the guide vane 130 may control the level of opening the supply flow path 110 according to a predetermined control value.

The fluid flowing as described above may be compressed by the operation of the compressor 140 and may be ejected to a guide flow path 171 connected to the compressor 140. In this case, the first sensor unit 161 and the second sensor unit 162 may measure a current applied to the drive unit 150 and a pressure of the fluid in the guide flow path 171, respectively.

The measured current applied to the drive unit 150 and the measured pressure of the fluid in the guide flow path 171 may be transmitted from the first sensor unit 161 and the second sensor unit 162 to the first controller 191 and the second controller 192, respectively.

In the exemplary embodiment, the first controller 191 may calculate flow of the fluid passing through the compressor 140 based on the transmitted current applied to the drive unit 150. Particularly, the current applied to the drive unit 150 as described above may be proportional to the flow of the fluid passing through the compressor 140.

When, as described above, the flow of the fluid passing through the compressor 140 is calculated based on the transmitted current and the pressure of the fluid in the guide flow path 171 is measured, the first controller 191 may characterize the flow of the fluid passing through the compressor 140 and the pressure of the fluid in the guide flow path 171 as the operation point OP of the compressor 140. Particularly, in a flow-pressure graph, an X-coordinate of the operation point OP of the compressor 140 may indicate the flow of the fluid passing through the compressor 140 and a Y-coordinate of the operation point OP of the compressor 140 may indicate the pressure of the guide flow path 171 as shown in FIG. 2.

In the exemplary embodiment, the first controller 191 may compare the operation pressure of the operation point OP of the compressor 140 with a predetermined operation pressure. Also, the first controller 191 may determine whether the current of the drive unit 150 according to the operation point OP of the compressor 140 is over a predetermined current. When the determining process is completed, as described above, the first controller 191 may calculate the first control value and the second control value and may select a smaller one of the first control value and the second control value to control the guide vane 130 according to one of the first and second control value. Particularly, since the first control value is generally smaller than the second control value, the control unit 190 may control the guide vane 130 according to the first control value. In the exemplary embodiment, the first controller 191 may control the guide vane 130 to allow the pressure of the fluid in the guide flow path 171, which is a value of the Y-coordinate of the operation point OP of the compressor 140, to be the same as a predetermined operation pressure. Particularly, the predetermined operation pressure, which is set as an actual operation pressure of the compressor 140, may be determined as a pressure line PL having a linear form by one of the first controller 191 and the second controller 192. Accordingly, the compressor 140 may operate along the pressure line PL as shown in FIG. 2.

When the first controller 191 controls the guide vane 130 as described above, the guide vane 130 may be excessively opened. In this case, an overcurrent may flow through the drive unit 150 and the current measured by the first sensor unit 161 may be over the predetermined current. In the situation described above, as a signal for reducing the level of opening the guide vane 130, the second control value generated by the first controller 191 becomes smaller than the first control value and the first controller 191 may control the guide vane 130 by using the second control value.

On the other hand, the second controller 192 may determine whether the operation point OP of the compressor 140 is over a greater one of the first anti-surge control line SCL1 and the second anti-surge control line SCL2 while operating as described above.

In the exemplary embodiment, the second controller 192 may determine the first anti-surge control line SCL1 based on the operation point OP of the compressor 140. In this case, the first anti-surge control line SCL1 may be determined as being offset from the operation point OP of the compressor 140 by the first surge margin ΔM1. Particularly, the first surge margin ΔM1 may be previously determined by the second controller 192. Also, the second controller 192 may determine the first anti-surge control line SCL1 to be offset from the operation point OP of the compressor 140 to left thereof in the flow-pressure graph.

The control unit 192 may also determine the second anti-surge control line SCL2 to be offset from the surge occurrence line SL, where a surge actually occurs, by a second surge margin ΔM2. In exemplary embodiment, the surge occurrence line SL and the second surge margin ΔM2 may be previously determined by the control unit 190, and the second anti-surge control line SCL2 may also be previously determined by the control unit 190.

The second anti-surge control line SCL2 determined as described above may be formed right of the surge occurrence line SL in the flow-pressure graph. Particularly, the second anti-surge control line SCL2 may be determined to have the second surge margin ΔM2 of about 10% from the surge occurrence line SL.

When the first anti-surge control line SCL1 and the second anti-surge control line SCL2 are determined as described above, the second controller 192 may determine the greater one of the first anti-surge control line SCL1 and the second anti-surge control line SCL2 as described above. In exemplary embodiment, since the first anti-surge control line SCL1 is generally greater than the second anti-surge control line SCL2, the second controller 192 may select the first anti-surge control line SCL1 and may control the flow control valve 180 according to the first anti-surge control line SCL1.

In detail, when the first anti-surge control line SCL1 is determined as described above, the first anti-surge control line SCL1 may be located on left of the operation point OP of the compressor 140. In this case, since the operation point OP of the compressor 140 is formed to be greater than the first anti-surge control line SCL1, the second controller 192 does not control the flow control valve 180 but the first controller 191 may control the guide vane 130 as described above.

On the other hand, while the second controller 192 is controlling as described above, an abnormality may occur in at least one of the guide vane 130, the inlet filter 120, the compressor 140, the guide flow path 171, and the external device (E), or the operation point OP of the compressor 140 may vary with the operation of the compressor 140. In this case, the first anti-surge control line SCL1 may be changed to be offset from the operation point OP of the compressor 140 by the first surge margin ΔM1. Also, the first anti-surge control line SCL1 may be changed by a rate limit previously determined by the second controller 192. On the contrary, the operation point OP of the compressor 140 may be changed to be over the rate limit of the first anti-surge control line SCL1.

When the operation point OP of the compressor 140 moves as described above, the operation point OP of the compressor 140 may pass the first anti-surge control line SCL1 and may be located between the first anti-surge control line SCL1 and the second anti-surge control line SCL2 as shown with an arrow in FIG. 3. That is, the operation point may move toward the surge occurrence line SL. In this case, the second controller 192 may control the flow control valve 180 to allow the operation point OP of the compressor 140 to be over the first anti-surge control line SCL1. That is, the second controller 192 allows the operation point OP to be located on the right side of the first anti-surge control line SCL1.

In detail, in the case as described above, the second controller 192 may generate the third control value and the fourth control value. In this case, the third control value is a value for controlling the flow control valve 180 to allow the Y-coordinate of the operation point OP of the compressor 140 to correspond to the pressure line PL when the Y-coordinate of the operation point OP of the compressor 140 is out of the pressure line PL. Particularly, the third control value may be usually generated to correspond to the pressure line PL when the operation point OP of the compressor 140 moves in a direction of the Y-axis, regardless of a surge.

Also, the fourth control value is a value for controlling the flow control valve 180 to allow the X-coordinate of the operation point OP of the compressor 140 to be over one of the first anti-surge control line SCL1 and the second anti-surge control line SCL2 when the X-coordinate of the operation point OP of the compressor 140 is less than one of the first anti-surge control line SCL1 and the second anti-surge control line SCL2.

Accordingly, the third control value may be not generally generated when the surge of the compressor 140 occurs, and the second controller 192 may control the flow control valve 180 by mainly generating the fourth control value.

On the other hand, when the third control value and the fourth control value are generated as described above, the second controller 192 may select the smaller one of the third control value and the fourth control value. In this case, a control value for increasing the level of opening the flow control valve 180 may be the smaller one of the third control value and the fourth control value. Hereinafter, for convenience of description, a case in which the fourth control value is the smaller one of the third control value and the fourth control value will be described in detail.

When the fourth control value is selected as described above, the second controller 192 may open the flow control valve 180 according to a level of opening the flow control valve 180 corresponding to the fourth control value. In this case, when the flow control valve 180 is opened, the operation point OP of the compressor 140 may pass the first anti-surge control line SCL1 and may move to right of the first anti-surge control line SCL1. Particularly, the operation point OP of the compressor 140 may move on the pressure line PL, may pass a first control point C1 where the pressure line PL and the first anti-surge control line SCL1 cross each other, and may move to right of the first control point C1.

The control method as described above may be performed at the first controller 191 and the second controller 192 at the same time. Particularly, the first controller 191 may control as described above, and simultaneously, the second controller 192 may resolve the surge as described above. Also, the second controller 192 may control to resolve the surge as described above, and simultaneously, the first controller 191 may control the guide vane 130 as described above.

On the other hand, in addition to the case as described above, according to the variance of the operation point OP of the compressor 140, the first anti-surge control line SCL1 may become smaller than the second anti-surge control line SCL2. In detail, the first anti-surge control line SCL1 may be disposed left of the second anti-surge control line SCL2.

In this case, the second controller 192 may select the second anti-surge control line SCL2 to control the compressor 140 to prevent the surge of the compressor 140. In detail, when the second anti-surge control line SCL2 is selected, the second controller 192 may compare a second control point C2 where the second anti-surge control line SCL2 and the pressure line PL cross each other, with the X-coordinate of the operation point OP of the compressor 140 as shown in FIG. 4.

When the X-coordinate of the operation point OP of the compressor 140 is less than the second control point C2, the second controller 192 may control the flow control valve 180 to be opened similarly as described above. Particularly, in the case as described above, the second controller 192 may generate the fourth control value to control the flow control valve 180. In this case, when the flow control valve 180 is opened, the operation point OP of the compressor 140 may move to pass the second control point C2 and to be over the second control point C2. When the operation point OP of the compressor 140 is over the control point C2 as described above, the second controller 192 may control the flow control valve 180 to be suspended.

Accordingly, since the compressor system 100 may prevent the occurrence of a surge of the compressor 140 by using the first anti-surge control line SCL1 before arriving at the second surge control line SCL2, it is possible to stably operate the compressor system 100. Also, since the compressor system 100 may allow the second controller 192 to precisely determine the first surge margin ΔM1 and the rate limit of the first anti-surge control line SCL1 in advance through experiments, it is possible to precisely control the compressor system 100. Particularly, since the compressor system 100 does not need to perform an additional difference operation control, it is possible to remove noise caused by the difference operation control.

While exemplary embodiments have been particularly shown and described above, it will be understood by those of ordinary skill in the art that various changes in form and details may be made therein without departing from the spirit and scope of the present inventive concept as defined by the following claims.

What is claimed is:

1. A compressor system comprising:

a guide vane;

a compressor configured to compress a fluid flowing from the guide vane;

a drive unit connected to the compressor and configured to drive the compressor;

a guide flow path connecting the compressor and an external device;

a branch flow path branching off from the guide flow path;

a flow control valve configured to open and close the branch flow path;

a sensor unit configured to measure a current of the drive unit and a pressure of the guide flow path; and a control unit configured to control at least one of the guide vane, the drive unit, and the flow control valve, configured to calculate an operation point of the compressor based on the current of the drive unit and the pressure of the guide flow path, configured to compare the operation point of the compressor with a greater one of a first anti-surge control line determined to be offset from the operation point by a first surge margin and a second anti-surge control line determined to be offset from a surge occurrence line by a second surge margin and configured to control the flow control valve according to the comparison.

2. The compressor system of claim 1, wherein the control unit is configured to predetermine at least one of the first surge margin and the second surge margin.

3. The compressor system of claim 1, wherein the first anti-surge control line varies in response to variation of the operation point.

4. The compressor system of claim 3, wherein the first anti-surge control line varies in response to a predetermined rate limit determined by the control unit.

5. The compressor system of claim 1, wherein the control unit controls the flow control valve to allow the operation point to be over a first control point on the first anti-surge control line in response to the operation point being placed between the first anti-surge control line and the second anti-surge control line.

6. The compressor system of claim 5, wherein the first control point comprises an intersection point between a pressure line of the guide flow path and the first anti-surge control line.

7. The compressor system of claim 1, wherein the control unit controls the flow control valve to allow the operation point to be over a second control point on the second anti-surge control line in response to the operation point being less than the second anti-surge control line.

8. The compressor system of claim 7, wherein the second control point comprises an intersection point between a pressure line of the guide flow path and the second anti-surge control line.

9. The compressor system of claim 1, wherein the sensor unit comprises:

a first sensor unit configured to measure the current of the drive unit; and a second sensor unit configured to measure the pressure of the guide flow path.

10. The compressor system of claim 1, wherein the control unit is configured to control the flow control valve to allow the operation point to move along a pressure line of the guide flow path.

11. A method of controlling a compressor system, the method comprising:

determining a first anti-surge control line offset from an operation point of a compressor by a first surge margin and a second anti-surge control line offset from a surge occurrence line by a second surge margin;

determining a greater one of the first anti-surge control line and the second anti-surge control line;

comparing the operation point of the compressor with the greater one of the first anti-surge control line and the second anti-surge control line; and controlling at least one of a guide vane and a flow control valve to allow the operation point of the compressor to be greater than the greater one of the first anti-surge control line and the second anti-surge control line.

12. The method of claim 11, further comprising predetermining at least one of the first surge margin and the second surge margin.

13. The method of claim 12, wherein the first anti-surge control line varies in response to variation of the operation point.

14. The method of claim 13, wherein the first anti-surge control line varies in response to variation of a predetermined rate limit determined by the control unit.

15. The method of claim 11, wherein the controlling comprises controlling the flow control valve to allow the operation point to be over a first control point on the first anti-surge control line in response to the operation point being placed between the first anti-surge control line and the second anti-surge control line.

16. The method of claim 15, wherein the first control point comprises an intersection point between a pressure line of the guide flow path and the first anti-surge control line.

17. The method of claim 11, wherein the controlling comprises controlling the flow control valve to allow the operation point to be over a second control point on the second anti-surge control line in response to the operation point being less than the second anti-surge control line.

18. The method of claim 17, wherein the second control point comprises an intersection point between a pressure line of the guide flow path and the second anti-surge control line.

19. The method of claim 11, wherein the controlling comprises controlling the flow control valve to allow the operation point to move along a pressure line of the guide flow path.

* * * * *